United States Patent [19]

Collins

[11] Patent Number: 4,695,020

[45] Date of Patent: Sep. 22, 1987

[54] APPARATUS FOR HOLDING DISPOSABLE BAGS

[76] Inventor: John Collins, Bldg. A-2-Apt. #412, 7715 SW. 86th St., Miami, Fla. 33143

[21] Appl. No.: 878,624

[22] Filed: Jun. 26, 1986

[51] Int. Cl.[4] ..... B65B 67/04

[52] U.S. Cl. ..... 248/100; 248/95

[58] Field of Search ..... 248/99, 100, 101, 97, 248/174, 95; 383/34, 34.1, 47

[56] References Cited

U.S. PATENT DOCUMENTS

| | | | |
|---|---|---|---|
| 2,305,863 | 12/1942 | Ginter | 248/100 |
| 3,370,787 | 2/1968 | Lindholm et al. | 248/99 X |
| 3,861,125 | 1/1975 | Hagemeister | 248/99 X |
| 3,870,261 | 3/1975 | McSwain | 248/101 |
| 4,332,361 | 6/1982 | McClellan | 248/99 X |
| 4,398,689 | 8/1983 | Prader | 248/99 |
| 4,487,388 | 12/1984 | Provan | 248/99 X |
| 4,579,307 | 4/1986 | Malik | 248/99 |

*Primary Examiner*—Ramon O. Ramirez
*Attorney, Agent, or Firm*—Richard M. Saccocio

[57] ABSTRACT

Bag holding apparatus is disclosed comprising a foldable structure which permits the attachment thereto of reusable plastic or paper bags. A planar member is foldable into a back member, side members hingedly rotatable into a perpendicular position with respect to the back member on each side thereof, and a top member hingedly rotatable down onto the top edges of the side members. Alternative means are formed into the side members to allow the attachment of the reusable bags to the foldable structure. One alternative means comprises contoured cutouts in the side members whereby a reusable bag having handles attached thereto may be secured to the cutouts in the side members. Another alternative means comprises snap means whereby a handless bag may be secured to the side members with the thickness of the bag being captured between a raised protrusion which snap fits within a hole.

10 Claims, 6 Drawing Figures

APPARATUS FOR HOLDING DISPOSABLE BAGS

BACKGROUND OF THE INVENTION

1. Field of the Invention

This invention, in general, pertains to the field of apparatus for holding bags in an open position and, in particular, to the field of bag-holding apparatus whereby previously-used disposable bags may be re-used in conjunction with apparatus for holding the bag in an open position such that a refuse container is formed thereby.

2. Description of the Prior Art

Modern day living requires that the element of convenience be incorporated in just about every facet of life. Convenience takes on many forms. Modern day transportation including the automobile is one form of convenience. The fast food industry is yet another form of convenience. Still another form of convenience is the disposable aspect of many modern day products.

It has become cheaper to make items which are disposable rather than provide replacements for the worn out parts which allow retaining and reuse of the more expensive original parts. Thus, today, we have disposable pens, razors, and even cigarette lighters. Once any part is worn out, used up or nonfunctioning, the entire device is thrown away. However, modern science and engineering is so exacting that within some items the various parts of the device are designed to wear out together rather than individually so that many inexpensive parts may be used to lower the overall price of the device.

Plastic disposable bags or containers is yet another convenience item of modern day living. Paper bags are still in use in, for example, grocery stores, but their use is almost nonexistent in other stores. Even in grocery stores the advent of plastic bags is becoming more and more wide spread. Such bags are, for example, used for dairy products, meat products, frozen products, deli products, etc., where moisture is present and can cause damage to paper bags.

Once the plastic bags or containers or even the paper bags or containers are used, they are, in general, disposed of or thrown away. In most instances, the bags are still totally usable in that they are not torn, ripped, or otherwise damaged, and are substantially clean inside and out so that no adverse sanitary conditions are involved. Yet, these perfectly good bags are simply thrown away.

A major reason for the widespread non-reuse of disposable bags is because of the nature of the bags themselves. These bags do not retain an open shape and thereby collapse upon themselves without any supporting structure. Also the different size bags do not readily lend themselves for use with, for example, a container within which the bag is placed and the top edges thereof are pulled around the upper lip of the container. Even within such a container, unless the upper edges are secured thereby, the bag will collapse therein and not present an open position. Further, a bag all by itself in a corner or even under a closed cabinet is not an aesthetically pleasing sight and is subject to being knocked over causing spillage of the trash therein. Thus, there are certain inherent disadvantages of reusing bags by themselves or with currently available support apparatus.

An open entrance of a trash container is extremely important in that it is much easier to place trash or other debris in an open container than it is in a folded-over or otherwise closed container. The folded-over container would have to be manipulated by one of a person's hands and even then because of the soft nature of the disposable bags, only a small portion becomes open. The remaining other portions of the upper end usually stay in a collapsed, closed position. This difficulty in trying to manipulate the bag to open it while attempting to place trash therein further explains why reusable bags are for the most part thrown away.

Accordingly, there exists a need to provide apparatus whereby disposable bags of varying sizes may be conveniently reused. The fulfillment of such need is a primary goal of the present invention.

Another object of the present invention is to provide apparatus permitting reuse of disposable bags, which apparatus is itself convenient and easy to use.

Another object of the present invention is to provide bag-holding apparatus which allows for simple attachment of a disposable bag thereon.

Another object of the present invention is to provide apparatus permitting reuse of a disposable bag in such a manner that the bag may be closed or covered at all times except when debris is being inserted therein.

The above-stated objects as well as other objects which although not specifically stated, but are intended to be included within the scope of the present invention, are accomplished by the present invention.

SUMMARY OF THE INVENTION

The above objects as well as others are achieved by the present invention which comprises apparatus for holding disposable bags in an open but covered position or in a closed position which is readily opened.

In a preferred embodiment, foldable apparatus includes a back portion, two side portions, and a top cover portion. The back portion provides for the apparatus to be attached to any convenient vertical surface such as the inside surface of a cabinet door. Each side portion, located at each end of the back portion, extends therefrom in a perpendicular direction with a top edge thereof being inclined downward from the horizontal. Each side portion is provided with various openings, cutouts, and specially-shaped surfaces which allow for the firm attachment thereto the top end of a disposable plastic or paper bag. The various cutouts and shapes are arranged so that one portion of the top edge of a disposable bag hooks around a first lower opening and then around a upper second surface but in opposite directions such that the disposable hangs down from the side portions in a manner whereby a generally oval or rectangular opening at the top portion of the bag results. A folded-over upper edge of each side portion provides for the retention of the upper end of a paper bag in an open position. The top portion of the apparatus folds over the open end of the disposable bag so as to form a closure lid. The closure lid is hinged to the back portion of the apparatus so that it may be easily lifted to place trash or debris in the container and will automatically resume a covered position thereafter. The closure lid is also provided with snap means which function in conjunction with mating features on the side portions of the device so that the upper end of the suspended bag may be tightly closed when not being used and thereby prevent undesired odors from emanating thereform.

Various other objects, advantages and features of the invention will become apparent to those skilled in the art from the following discussion taken in conjunction with the following drawings, in which:

DESCRIPTION OF THE PREFERRED EMBODIMENTS

Figure 1:
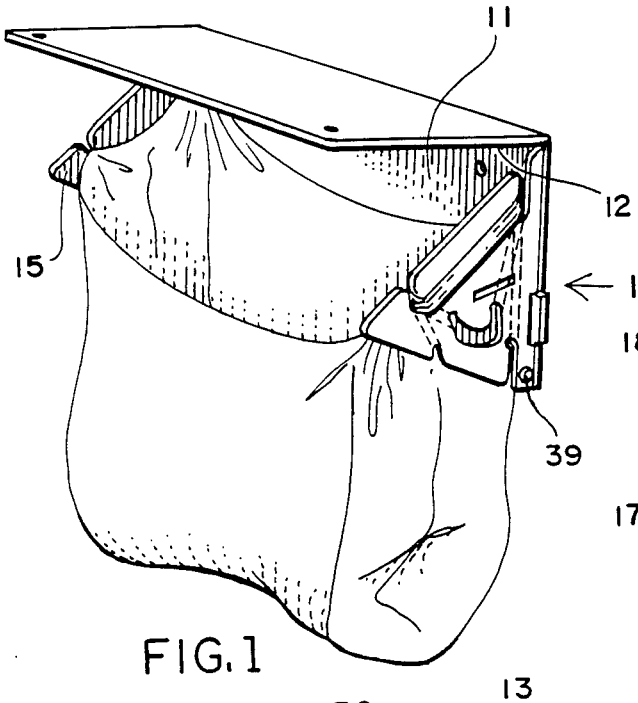
FIG. 1 comprises an isometric view of the inventive apparatus as installed and arranged for use with a disposable bag attached thereto.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings wherein like characteristics and features of the present invention shown in the various figures are designated by the same reference numerals.

In FIG. 1, there is shown the general overall operative arrangement of the present invention in conjunction with a disposable bag, which may comprise a previously-used plastic bag attached thereto. The plastic bag does not form part of the invention. The inventive apparatus 10 includes a back portion 11 and a top portion 12, which is hinged 13 along the upper horizontal end of back portion 11. The hinged connection 13 of upper portion 12 to back portion 11 is such that the force of gravity is sufficient to cause the upper portion to rest on the upper edges 14 of each side portion 15. (See also FIGS. 2 and 3.) In FIG. 1, the position of upper portion or lid 11 relative to side portions 15 is shown in a partially opened position for purposes of clarity. It being understood that in its normal position, lid 11 fits on top of and closes the opening of the disposable bag created by the attachment of the disposable bag to the side portions 15 of the inventive apparatus 10. Lid or upper portion 12 may, of course, be further opened than its position shown in FIG. 1.

Figure 2:
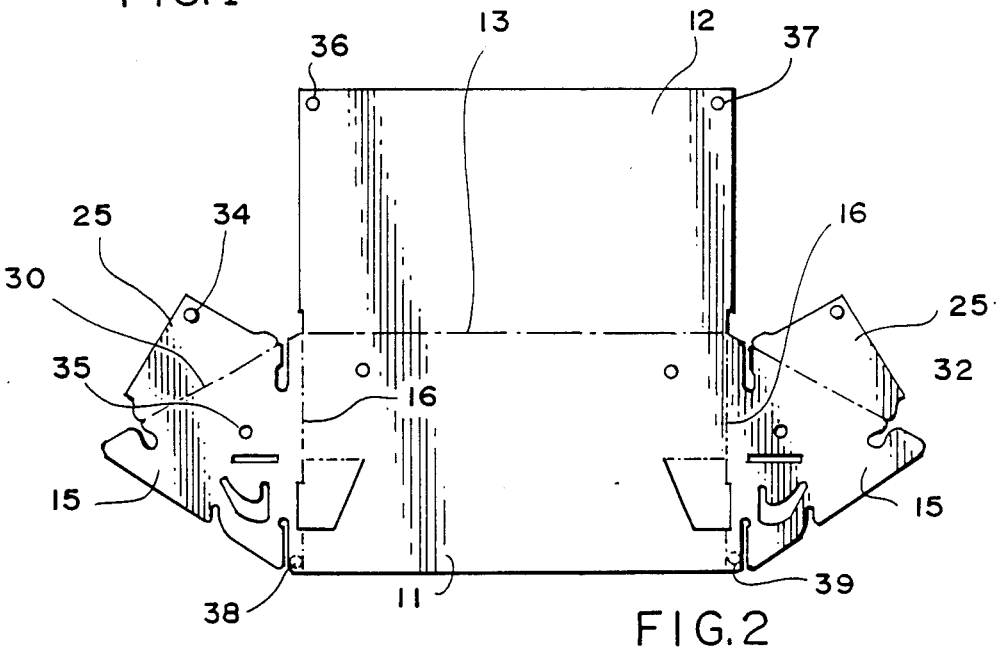
FIG. 2 is a plan view of the inventive apparatus shown in a flat, unfolded arrangement.
Figure 2A:
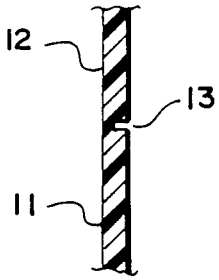
FIG. 2A is a partial, cross-sectional view of the hinge of the inventive apparatus.
Figure 5:
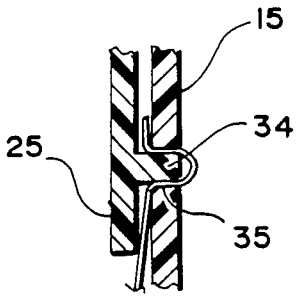

In FIG. 2, the inventive apparatus 10 is shown in a flat, unfolded position. This position represents, for example, a configuration of the inventive apparatus as it is stamped from cardboard or injection molded using a material such as plastic. The use of different base materials requires slight differences in the makeup of hinge 13. For example, if cardboard is used, the hinge may comprise cutting through the thickness of the cardboard along hinge edge 13 substantially through the thickness of the cardboard so that a readily rotatable hinge results therefrom. With plastic, the injected thickness of the material joining lid 11 and back portion 12 also comprises the hinge 13. In this instance, the material joining the two portions 11 and 12 would be of an appropriate thickness to result in a freely rotatable hinge. FIG. 2A shows in cross-section such details of hinge 13.

Figure 3:
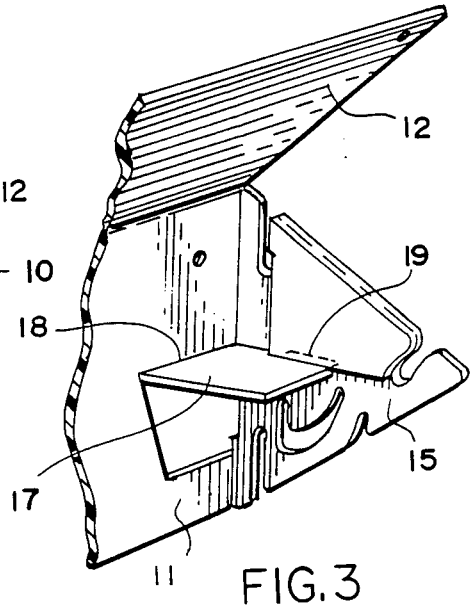
FIG. 3 is an isometric view of one portion side of the inventive apparatus arranged for use but without a disposable bag attached thereto.

End flaps 15 may be similarly attached or hinged to back portion 11. That is, by means of a reduced thickness of material joining such portions. Thus, end portions 15 are freely rotatable about vertical hinges 16. FIG. 3 depicts the installed and assembled position of one side portion 15 relative to back portion 11. In FIG. 3, side portion 15 has been rotated to a position perpendicular to back portion 11. A brace 17 comprising a flap which is cut through back portion 11 along three edges and partially through the fourth edge to form a hinge 18 is also rotated to a perpendicular position relative to back portion 11 and is interlockingly connected with side portion 15. As shown, the interlocking connection comprises a tab 19 on brace 17 which fits within a slot 20 which is provided within side portion 15. The size of cutout 20 and the thickness of tab 19 may be such that a slight press fit is required to insert tab 19 into slot 20 so that brace 17 provides for a substantially fixed position of side portion 15 relative to back portion 11. In other words, when brace 17 is interlockingly connected to side portion 15, side portion 15 is then fixed in position.

Figure 4:
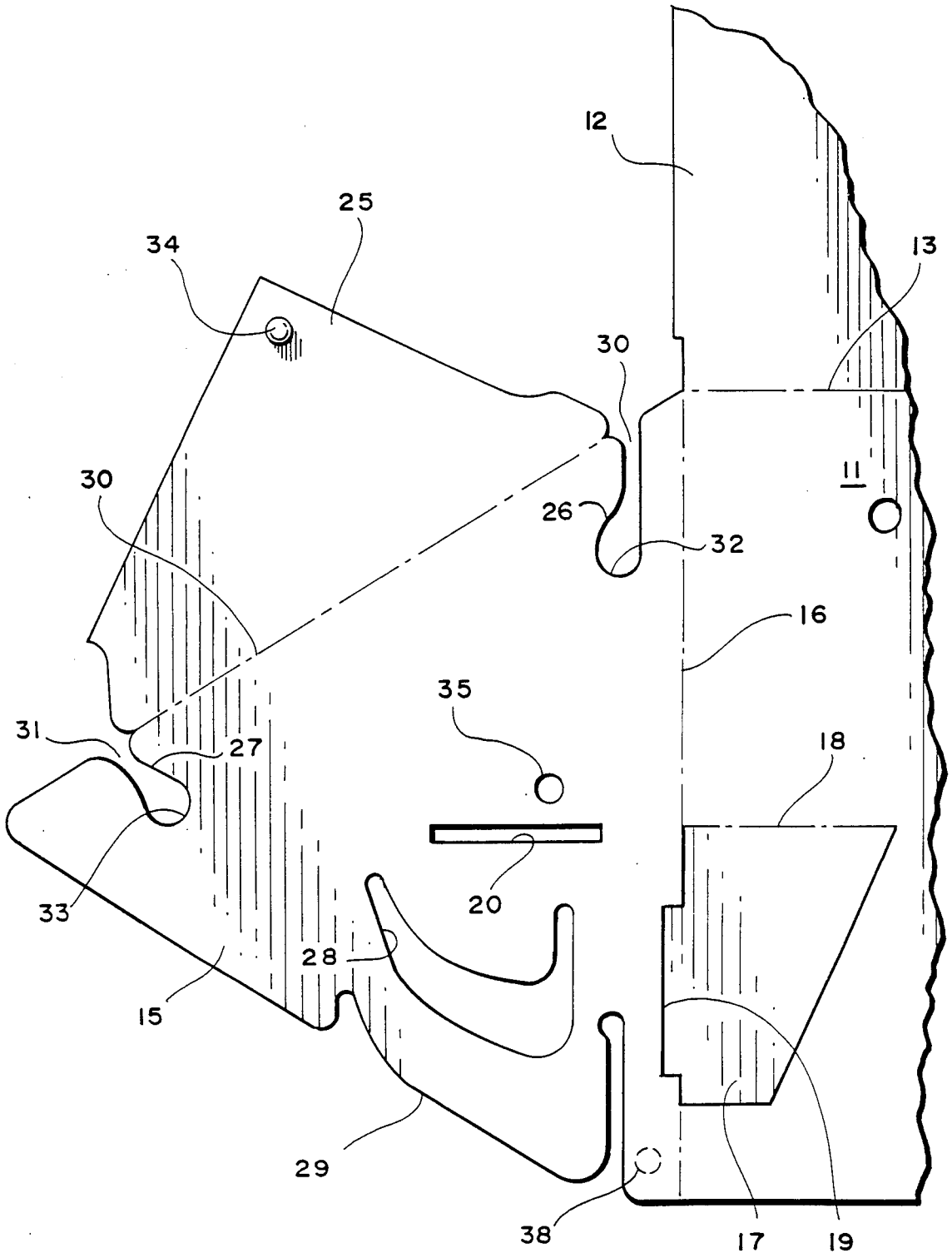
FIG. 4 is an enlarged plan view of one side portion of the inventive apparatus in an unfolded position; and, FIG. 5 is a partial cross-sectional view taken through FIG. 3 illustrating the attachment of a paper or plastic container thereto by snap fastening means.

FIG. 4 shows a flat arrangement of one side and end portion of the inventive apparatus 1. A handleless bag-holding flat 25 is attached to side portion 15. Also shown in the figures is a portion of back portion 11, and a portion of lid portion 12. In its normal position, flap 25 is folded down against the inside surface of end portion 15 as shown by the dotted lines in FIG. 4 and in its folded down position in FIG. 3. Cutouts 26 and 27 function in conjunction with either cutout 28 or the contoured shape of edge 29. In general, the disposable plastic bags for which the inventive apparatus 10 is intended to be used includes handles which are fabricated as an integral part of the plastic bag. Generally, these consist of a rounded upper portion on either side of the bag with an opening therethrough. The rounded portions in the openings therethrough extend above the body of the bag in a manner consist with handles on a shopping bag. Each cutout 26 and 27 includes an entrance portion 30 and 31 and a wider rounded end portion 32 and 33, respectively. The narrower entrance portion is of sufficient size to allow the width of the handles of the plastic bag to be progressively inserted therethrough and then be cumulatively gathered within and rest upon the wider end portions 32 and 33. The upper end of the handle of the plastic bag is then pulled down and fitted within the opening formed by cutout 28 or around contoured edge 29 and is then hooked on thereto. Whether cutout 28 or contoured edge 29 is used depends upon the length of the handle of the plastic bag. When a plastic bag is thusly attached to the side portions 15 of the inventive apparatus 10, the weight of any object which is inserted within the plastic bag causes the bag to be pulled down which causes the handles of the bag to be further or more firmly locked in place on side portions 15.

Of importance is the fact that when a plactic bag is fitted or attached to the inventive apparatus 10, the angled upper edge surface of each side portion 15 and the manner of attaching the plastic bag to the side portions 15 results in the back portion of the plastic bag being positioned physically higher relative to its front portion (See FIG. 1). Yet, the plastic bag hangs vertically down from its attached position on the inventive apparatus 10. In this manner, when placing debris or other such material within a plastic bag held by the inventive apparatus 10, the lower front portion of the plastic bag prevents inadvertent spilling of such debris. The high back portion and lower front portion of the bag thus facilitates, for example, the scraping of waste matter from a plate into the plastic bag without causing the waste matter to get onto the inventive apparatus or be spilled on the floor.

Flaps 25 are freely foldable onto the inside surface of end portions 15. Thus, the hinged joint 30 connecting flap 25 to end portion 15 is flexible so that in its normal position, flap 25 lays against the inside surface of end portion 15. In other words, it is preferable that hinge joint 30 does not cause any appreciable springback of flap 25 although the presence of a slight amount of springback still allows fastening of flap 25. On the other hand, a slight amount of springback is desirable by hinges 16 and 13. Means are provided with flaps 25 and side portions 15 for purposes of attaching a handleless plastic bag or a handleless paper bag to the inventive apparatus 10. In one embodiment, the handleless bag-holding means comprises snap fastening means, having mating parts respectively attached to flap 25 and to side portion 15. In FIG. 4 a hole 35 is provided in side portion 15 while a raised circular member 34 is provided on flap 25. The raised circular member 34 snap fits within hole 35 when flap 25 is folded down against side portion 15. By inserting the upper end of a handleless bag therebetween, the compliant nature of the material from which the bag is made allows the upper end of the bag to be formed around the raised circular member 34 and into hole 35 when the snap means are fitted together. This, in effect, sandwiches the thickness of the bag between the mating snap members 35 and 34 and causes the bag to be firmly attached to the inventive apparatus 10. For additional grip, a number of snap fastening means may be provided with or attached to flap 25 and side portion 15. The diameter of holes 35 relative to the diameter of circular members 34 are such that a slight press fit exists between the parts when they are mated or snapped together.

Flap or lid 12 normally covers the opening created when a plastic or paper bag is attached to the inventive apparatus 10. Such covering provides for proper sanitary conditions yet allows for easy opening when it is desired to place any trash into the plastic or paper container. Once the container is filled, it may easily be removed from the inventive apparatus 10 using a procedure reverse to that explained above and appropriately discarded. Then, a new paper bag or plastic container may be fitted to the inventive apparatus 10. Snap means are also provided on lid 12 and sides 15 comprising raised circular members 38 and 39, which fit and mate with holes 36 and 37, respectively. When a bag is attached to the inventive apparatus 10 and is partially filled, side portions 15 may be folded flat against back portion 11, thereby causing the upper end of the bag to be closed. Then, lid 12 rotated down against side portions 15 and snap fitted thereto by snapping raised members 38 and 39 into holes 36 and 37, respectively. In this manner, the entire upper end of the partially filled bag is firmly closed, which is desirable for sanitary reasons. In order to again place other debris in the reusable bag attached to the inventive apparatus 10, a reverse procedure to that described may be used.

Holes 40 provided in back portion 11 allows for attachment of the inventive apparatus to a suitable vertical surface such as the inside of a cabinet or a door of the same or even the outside of the cabinet or a vertical wall. In any event, convenient apparatus obtains whereby plastic and paper containers may be reused with simplicity and under complete sanitary conditions.

While the invention has been described, disclosed, illustrated and shown in certain terms or certain embodiments or modifications which is has assumed in practice, the scope of the invention is not intended to be nor should it be deemed to be limited thereby and such other modifications or embodiments as may be suggested by the teachings herein are particularly reserved especially as they fall within the breadth and scope of the claims here appended.

I claim as my invention:

1. Bag-holding apparatus for attaching either a plastic or paper bag thereto and thereby allowing reuse of the bags, said apparatus comprising a back portion with rotatable top and side members attached thereto, brace members formed from said back member, each being hinge connected to said back portion along one edge of said brace member, said brace members each being received in slot means formed in said side members to keep said side members in a perpendicular position with respect to the back portion, said top member resting upon upper edges of said side members when said top member is rotated downward relative to said back member, and bag holding means for attaching said plastic or paper bag to said bag-holding apparatus.

2. The bag-holding apparatus of claim 1, wherein said bag-holding means comprises spaced apart contoured cutouts along the top edge of said side members and a contoured edge formed in the lower edge of said side members, whereby reusable bags having handles integral therewith may be fitted between said side members with said handles being folded over said top edges and fitting within said contoured cutouts and extending along said side members and hooking around said lower contoured edges.

3. The bag-holding apparatus of claim 2, wherein said bag-holding means further comprises a contoured cutout in each side member between said top and bottom edges, said cutout having an U shape, whereby the handles of said reusable bags may be hooked around said cutouts or said contoured lower edges depending upon the length of the handles on said bags.

4. The bag-holding apparatus of claim 1, wherein said bag-holding means comprises snap fastener means attached to said side members whereby said bag may be attached at the upper portion of each side thereof by said snap fastener means to each side member.

5. The bag-holding apparatus of claim 4, wherein said snap fastener means comprises two mating halves with one half being attached to said side members and the other half being attached to an extending portion of said side members, said extending portion being hinged to said side member, whereby the material from which said bag is made may be sandwiched between said mating halves of said snap fastener means thereby securing the bag to said bag-holding apparatus.

6. The bag-holding apparatus of claim 5, wherein the mating halves of said snap fastening means comprises a hole and a raised circular member matingly fittable within said hole.

7. The bag-holding apparatus of claim 1, further comprising snap fastener means attached to said top member and to said side members for closing the top portion of said bag when it is attached to said bag holding apparatus and after said brace members are disengaged from the side members and said side members and said top member are rotated flat against said back member.

8. The bag-holding apparatus of claim 1, wherein the upper edge of said side members are inclined downward from said back portion whereby the opening of said bag created by said bag-holding apparatus has a lower front edge and a higher back edge.

9. The bag-holding apparatus of claim 1, including means for attached said apparatus to a vertical surface.

10. The bag-holding apparatus of claim 1, wherein said apparatus is formed from a plastic material initially having a planar shape which is thereafter formable such that said side members are perpendicular to said back member and said top member rests on the upper edge of said side members.

* * * * *